US005544706A

United States Patent [19]

Reed

[11] Patent Number: 5,544,706

[45] Date of Patent: Aug. 13, 1996

[54] RETRIEVABLE SEALING PLUG COIL TUBING SUSPENSION DEVICE

[76] Inventor: Lehman T. Reed, 3219 Candlewood Dr., Bakersfield, Calif. 93306

[21] Appl. No.: 448,877

[22] Filed: May 24, 1995

[51] Int. Cl.[6] ..... E21B 33/04; E21B 19/00

[52] U.S. Cl. ..... 166/379; 166/382; 166/386; 166/88.2; 166/105

[58] Field of Search ..... 166/77.1, 77.3, 166/372, 375, 379, 65.1, 88.2, 88.3

[56] References Cited

U.S. PATENT DOCUMENTS

| | | | |
|---|---|---|---|
| 2,097,615 | 11/1937 | Burns et al. | 166/88.2 |
| 2,312,487 | 3/1943 | Roach et al. | 166/88.3 X |
| 2,338,767 | 1/1944 | Humason | 166/77.1 X |
| 2,824,757 | 2/1958 | Rhodes | 166/88.3 X |
| 3,438,654 | 4/1969 | Jackson, Jr. et al. | 166/88.3 X |
| 4,491,176 | 1/1985 | Reed | 166/65 R |
| 4,541,490 | 9/1985 | Bigbie et al. | 116/88.2 X |
| 4,646,827 | 3/1987 | Cobb | 166/88.2 |
| 4,708,201 | 11/1987 | Reed | 166/65.1 |
| 4,804,045 | 2/1989 | Reed | 166/97.5 |
| 5,000,719 | 3/1991 | Reed | 166/88 |
| 5,148,865 | 9/1992 | Reed | 166/76 |
| 5,199,495 | 4/1993 | Brammer et al. | 166/379 X |
| 5,465,794 | 11/1995 | McConaughy et al. | 166/375 |

OTHER PUBLICATIONS

Field Installation of Coiled Tubing ESP Completions, Tovar D. and Head, Soc. Petroleum Eng. ESP Workshop, Apr. 26–28, 1995.

*Primary Examiner*—Frank Tsay
*Attorney, Agent, or Firm*—F. Eugene Logan

[57] ABSTRACT

A retrievable sealing plug coil tubing suspension device for supporting coil tubing which supports a motor-pump assembly deployed at operating well depth in a well. The coil tubing houses the power cable connected to the motor of the motor-pump assembly. A diversionary member connected to a wellhead assembly supports the device. The device locks on the coil tubing and is installable and retrievable through a blowout preventor ("BOP") by reeling enough of the coil tubing out of the wellhead assembly so that the device can be unlocked from the coil tubing. After removing the device from the coil tubing, the coil tubing can be completely rewound on a reel and the motor-pump assembly serviced if desired. The well can be reworked through the BOP and the diversionary member if desired. Methods of installing the power cable in a single piece of coil tubing of great length, e.g. thousands of feet, connecting the power cable and coil tubing to the motor-pump assembly, and deployment of the motor-pump assembly in the well are disclosed.

25 Claims, 14 Drawing Sheets

RETRIEVABLE SEALING PLUG COIL TUBING SUSPENSION DEVICE

BACKGROUND OF THE INVENTION

In some wells where the in-situ well pressure is too low for economical operation of the well, the well can be made commercial by pumping the product from the well. Electric submersible pumps are frequently used in such low pressure wells. The electric submersible pump or motor-pump assembly are installed inside the production tubing string at an operating well depth and pump the product up the production tubing string. The production tubing string is supported or hung from the wellhead or a member attached thereto such as a tubing head member or spool.

The motor-pump assembly is usually supported by some means from the wellhead or more specifically from a member attached to the wellhead. In some cases the motor-pump assembly is supported by tubing string, continuous rod ("conrod") or braided steel cable which is deployed down the production tubing string. As the tubing string, conrod or braided steel cable is run into the well, the power cable for the motor-pump assembly is strapped, after a certain number of feet or interval, to the outside of the tubing string, conrod or braided steel cable.

When the motor-pump assembly is retrieved, as the tubing string, conrod or braided steel cable is pulled from the well, the straps holding the power cable must be removed, interval by interval, and conversely when the motor-pump assembly is reinstalled in the well, power cable straps are again installed after each interval.

Such power cable support systems have several disadvantages. For example, the power cable is exposed to the detrimental well fluids which can damage it. Retrieval of the motor-pump assembly for servicing is a costly and timely operation requiring un strapping and restrapping of the power cable to the outside of the tubing string, conrod or braided steel cable each and every time the motor-pump assembly is retrieved from, and reinstalled in, the well. It is an object of this invention to avoid these disadvantages and others.

SUMMARY OF THE INVENTION

Accordingly, there is provided by the principles of this invention a retrievable sealing plug coil tubing suspension device for suspension of a coil tubing. The device is positioned in a vertical passageway of a diversionary member or spool which is connected, either directly or indirectly, to a wellhead or casing head of a well. In general the term "wellhead subassembly" as used herein is intended to mean tubing heads, casing heads and any other type of wellhead for a well including other members which suspend the production tubing string such as a tubing head member or spool. Production tubing string frequently used has a 5.5 inches or 7 inches diameter.

The coil tubing has one end sealably attached to a motor-pump assembly which is to be deployed down the production tubing string of the well at an operating well depth. The other end of the coil tubing is above ground at a convenient distance from the wellhead assembly. Coil tubing frequently used has a 2.5 inches or 3.5 inches diameter.

a power cable installed within the coil tubing has one end connected to the motor of the motor-pump assembly. The other end of the power cable extends beyond the above ground end of the coil tubing and is connected to a power source.

The diversionary member supports the device. The device supports the coil tubing, and the coil tubing supports the motor-pump assembly attached thereto. The diversionary member has a vertical passageway running therethrough and a horizontal passageway and port in fluid communication the vertical passageway. Means for supporting the device is provided in the vertical passageway above the horizontal port. Said means can be an inner seating shoulder in the vertical passageway on which the device rests.

The diversionary member has means for securing the device. Such means can be locking screws or bolts which hold the device in the diversionary member. Other features such as sealant injection ports are preferably included in the diversionary member. The vertical passageway below the horizontal port is in fluid communication with a production tubing string deployed from the wellhead assembly.

The coil tubing and motor-pump assembly is deployed down the production tubing string. The coil tubing isolates the power cable from exposure to well fluids. Well fluids such as sour gas or reactive crude can cause deterioration to the power cable when it is strapped to the outside of the tubing string, conrod or braided steel cable. Thus in this invention since the power cable is inside the coil tubing the power cable can not be subjected to detrimental reactants in the well fluid.

When the device is locked to the coil tubing and locked in the vertical passageway, vertical production flow from the production tubing string is diverted to horizontal production flow through the horizontal port. Thus, when the device is in use, it functions also as a plug in the vertical passageway of the diversionary member above the horizontal port. The device both supports the coil tubing and plugs off vertical flow and diverts it to horizontal production flow. Hence this invention is called a retrievable sealing plug coil tubing suspension device. The retrievable aspects of the device will be explained below.

The device comprises a subassembly having outer housing means with a vertical channel therethrough, support means removably positioned in the vertical channel for supporting the coil tubing, and locking means for removably locking the outer housing means and support means around the coil tubing. The locking means is removably attached to the outer housing means so that when the outer housing means and support means are locked to the coil tubing they remained locked as the subassembly is lowered into the diversionary member and removed from the diversionary member. Thus the device is easily retrievable from the diversionary member by pulling the coil tubing from the diversionary member through a BOP. By "BOP" is meant a blowout preventor.

The device also has inner seal means, supported by the subassembly, for preventing fluid flow over the outside surface of the coil tubing in the space between the subassembly and the coil tubing. The inner seal means prevents fluid from flowing or leaking around the surface of the coil tubing, past the subassembly, and into the upper portion of the vertical passageway of the diversionary member above the device.

In one embodiment, the support means comprises a slip assembly. In a further embodiment, the slip assembly comprises a plurality of slips each having means for gripping the coil tubing and a partial conical outer surface adaptable for slidable positioning in an opposing conical section in the vertical channel of the outer housing. The slip assembly includes ring means for slidably supporting the slips in a spaced apart configuration. In a still further embodiment, the plurality of slips consist of a first slip, a second slip, and a third slip, and the ring means is a split ring having a first semi-ring member and a second semi-ring member. The first semi-ring member slidably supports the first slip and the third slip, and the second semi-ring member slidably supports the second slip and the third slip.

In one embodiment of this invention the outer housing means has an outside surface of revolution and an inside surface of revolution, and the locking means has an outside surface of revolution and an inside surface of revolution. A bottom portion of the outside surface of revolution of the locking means is removably positioned adjacent a top portion of the inside surface of revolution of the outer housing.

In a further embodiment, the device includes intermediate seal means for preventing fluid flow between the locking means and the outer housing. In a still further embodiment, the inner seal means seals the space between inside surface of revolution of the outer housing and the outside surface of revolution of the locking means. In yet a further embodiment, the intermediate seal means includes a resilient seal positioned in a circumferential recess on the outside surface of revolution of the locking means which bears on the inside surface of revolution of the outer housing.

In one embodiment, the inner seal means includes a recessed inner circumferential section extending downward on the inside surface of revolution of the locking means to an inner shoulder thereon, a packing material in the recessed inner circumferential section, and compression means for compressing the packing material against the recessed inner cirumferential section and the coil tubing. In a further embodiment, the compression means includes a compression ring having a lower annular section for pressing against the packing material, and force means for forcing the lower annular section of the compression ring downward against the packing material.

In a still further embodiment, the force means includes a plurality of space apart threaded blind bores on the locking means, a flange on the compression ring having a corresponding plurality of holes axially aligned with the threaded blind bores, and a plurality of threaded screws for insertion through the holes in the flange and screwing into the threaded blind bores, whereby the tightening of such screws compresses the packing material thereby forming the seal between the device and the coil tubing.

In another further embodiment, the force means includes an internally threaded section on the locking means, and an externally threaded section on the compression ring for screwing into the internally threaded section. In this embodiment downward rotation of the compression ring relative to the locking means compresses the packing material and forms the seal between the device and the coil tubing.

In a further embodiment, the device includes outer seal means for preventing fluid flow over the surface of the vertical passageway of the diversionary member in the space between the device and the vertical passageway. In a still further embodiment, the outer seal means is supported by the device. In yet a further embodiment, the outer seal means includes a resilient seal positioned in a circumferential recess on the outside surface of revolution of the outer housing for bearing against an opposing surface of the vertical passageway of the diversionary member.

There is also provided by the principles of this invention a system for supporting a coil tubing, the coil tubing having an end sealably attached to a motor-pump assembly and another end above ground. The coil tubing houses a power cable having an end connected to the motor of the motor-pump assembly and an above ground end for connecting to a power source. The coil tubing isolates the power cable from exposure to well fluids. The system comprises the retrievable sealing plug coil tubing suspension device and outer seal means described above, and also a diversionary member.

The diversionary member comprises a main body having a top and a bottom, a vertical passageway in the main body extending completely therethrough from the top to the bottom, and a horizontal port in the main body below the top and above the bottom. The horizontal port extends from a side of the main body into the vertical passageway. A bottom portion of the vertical passageway is for fluid communication with a top portion of a production tubing string. A lower portion of the main body is for removable attachment to a wellhead assembly. The diversionary member includes means for positioning the device in the vertical passageway above the horizontal port, and removable means for locking the device in the vertical passageway above the horizontal port. Examples of a diversionary member or spool are disclosed in my application Ser. No. 08/373,837, filed Jan. 17, 1995, entitled Unitary Diversionary-Tubing Hanger and Emergency Rod Seal, which is hereby incorporated herein by reference.

In the system, when the device is locked to the outer housing and the coil tubing, and locked in the vertical passageway of the diversionary member, vertical production flow from the production tubing string is diverted to horizontal production flow through the horizontal port.

Another advantage of this system is that when it is used on a wellhead assembly, there are no valves required in the vertical flow path above the production tubing string. Hence reworking of the well can be performed by attaching a BOP to the top of the diversionary member, retrieving the device through the top of the BOP, unlocking the device from the coil tubing, and reeling the coil tubing back onto its reel. The power cable remains in the coil tubing. If desired the motor-pump assembly can be removed from the end of the coil tubing and the entire length of coil tubing stored on its reel with the power cable inside the coil tubing. Reworking of the well can take place through the BOP in a conventional manner.

After reworking the well, the power cable can be reconnected to the motor and the motor-pump assembly reconnected to the coil tubing. The coil tubing with the motor-pump assembly attached thereto can then be reinstalled through the BOP back to operating well depth. Just before reaching operating well depth the device is locked on to the coil tubing. The device is then lowered and seated in the diversionary member and locked therein. No unstrapping and restrapping of the power cable is required.

Since some wells run to a depth of two miles or more, installation of the power cable inside a single and uncoupled length of coil tubing will be a challenging task. Accordingly, there is also provided by the principles of this invention a method for installing the power cable inside such very long lengths of coil tubing.

The method includes connecting a diversionary member having a vertical passageway and a BOP to the wellhead assembly, and running a first end of the coil tubing through the BOP, the diversionary member, and into the well until the end of the coil tubing is near the operating well depth. Then, while supporting the coil tubing with support means positioned on top of the BOP, cutting the coil tubing at a convenient length from the wellhead assembly, thereby forming a second end of the coil tubing.

The method includes attaching a first end of a power cable to a piston adaptable for fitting into, and sliding within, the coil tubing, inserting the piston with the power cable attached into the second end of the coil tubing, and driving the piston through the coil tubing with a pressurized fluid until the piston exits the first end of the coil tubing which is near the operating well depth. Pneumatic or hydraulic techniques can be used to drive the piston including pressurizes air. The power cable is then cut at a convenient distance from the second end of the coil tubing thereby forming a second end of the power cable.

The method includes retrieving the coil tubing with the power cable therein from the wellhead assembly, removing the piston from the first end of the power cable, connecting the first end of the power cable to a motor of a motor-pump assembly, and connecting the motor-pump assembly to the first end of the coil tubing. The motor-pump assembly wired to the power cable, and connected to the coil tubing with the power cable therein, is now ready for running into the well.

In a further embodiment, the method also includes attaching a simulator unit to the end of the coil tubing before running the coil tubing down the well. The simulator unit has an upper portion which is a piston receiver and a lower portion which is a motor-pump simulator. When the piston is driven through the coil tubing with the pressurized fluid the piston is also driven into the piston receiver. After retrieving the coil tubing from the well, the method includes disconnecting the piston receiver from the end of the coil tubing.

There is also provided by the principles of this invention a method for removably installing at an operating well depth a motor-pump assembly suspended by a coil tubing with a power cable housed therein, within a production tubing string supported at a wellhead assembly and deployed down a well. The method includes connecting a diversionary member having a vertical passageway and a BOP to the wellhead assembly. Then lowering a coil tubing connected to a motor-pump assembly, the motor of which has been wired to a power cable housed within the coil tubing, through the BOP and the diversionary member into the wellhead assembly and down the production tubing string until the motor-pump assembly is a small distance above the operating well depth.

The method includes supporting the coil tubing with first means positioned on top of the BOP, and installing an outer housing having a vertical channel around the coil tubing and on top of the first means. Then installing a slip assembly in the vertical channel of the outer housing between the outer housing and the coil tubing, setting the slip assembly in the outer housing around coil tubing, and attaching removable locking means to the outer housing and locking the outer housing and the slip assembly to the coil tubing with the locking means. Then removing the first means supporting the coil tubing, lowering the coil tubing into the well until the outer housing lands in the diversionary member, and securing the outer housing to the diversionary member.

In a further embodiment, the method includes removing the BOP from the wellhead assembly, and attaching a bonnet assembly to the top of the diversionary member around the coil tubing.

In one embodiment, the small distance is equal to about the distance between an inner seating shoulder of the diversionary member and an outer seating shoulder of the outer housing when the outer housing is on top of the first means. The small distance will span the combined lengths of the BOP and any other members between the BOP and the diversionary member.

DESCRIPTION OF THE PREFERRED EMBODIMENTS

Figure 17:
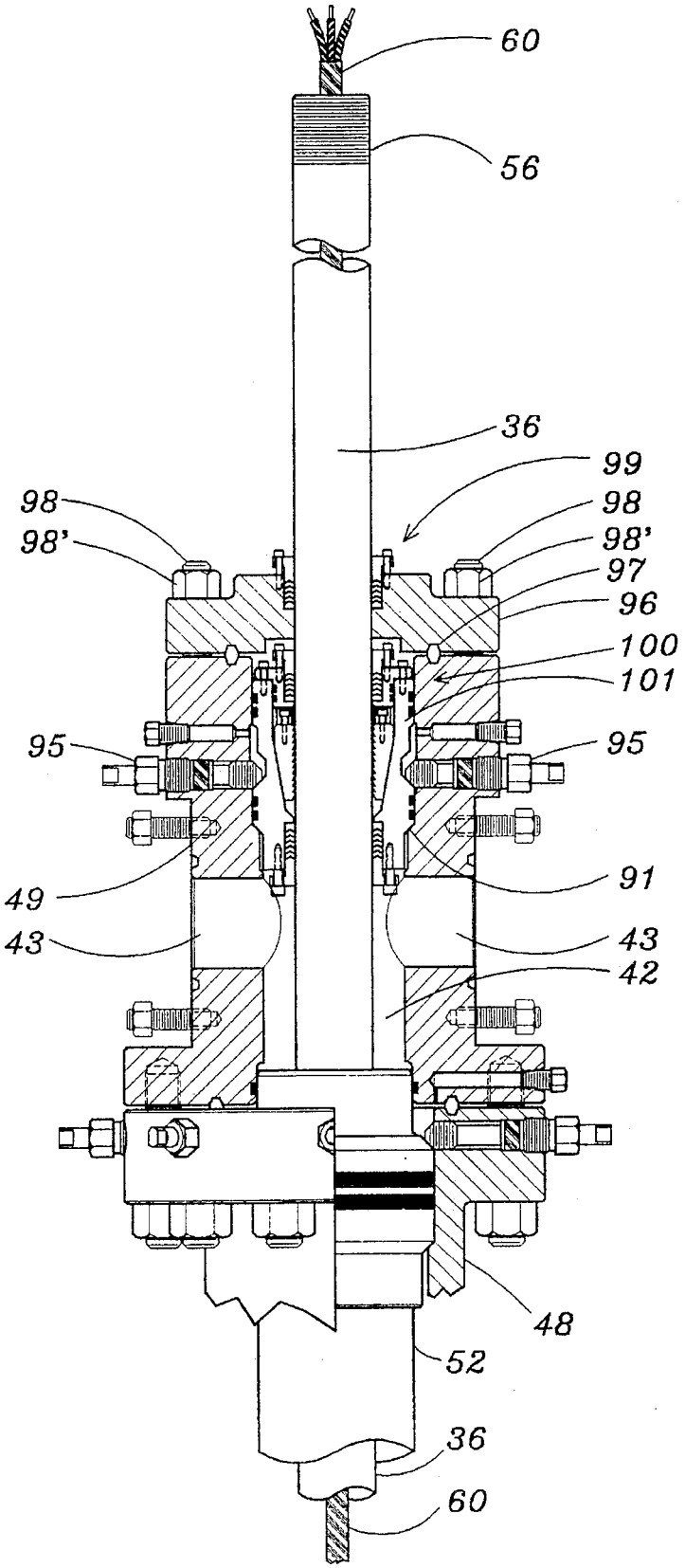
FIG. 17 is a cross-sectional view similar to FIG. 16 with a bonnet connected to the diversionary member and the well completed for electric submersible pump production.

With reference to FIG. 17, this invention concerns the suspension of an electric submersible pump or motor-pump assembly from coil tubing 36 with the power cable 60 inside the coil tubing rather than strapped to the outside of the coil tubing. The coil tubing with pump attached thereto are deployed within and down the production tubing string 52 with the product, e.g. oil, pumped to the surface in the annular space between coil tubing and the production tubing string. A retrievable sealing plug coil tubing suspension device 100 positioned in the vertical passageway 42 above the horizontal port 43 of a diversionary member 49, supports the coil tubing and blocks off or plugs the upper portion of the vertical passageway so that vertical production flow from production tubing string 52 is diverted to horizontal production flow through port 43.

It can be appreciated when the well runs to a depth of 8000 to 11000 ft or more, installation the power cable inside a single and uncoupled length of coil tubing can be a formidable and difficult task. One embodiment of this invention of a method for installing the power cable inside such very long lengths of coil tubing is described next.

Figure 1:
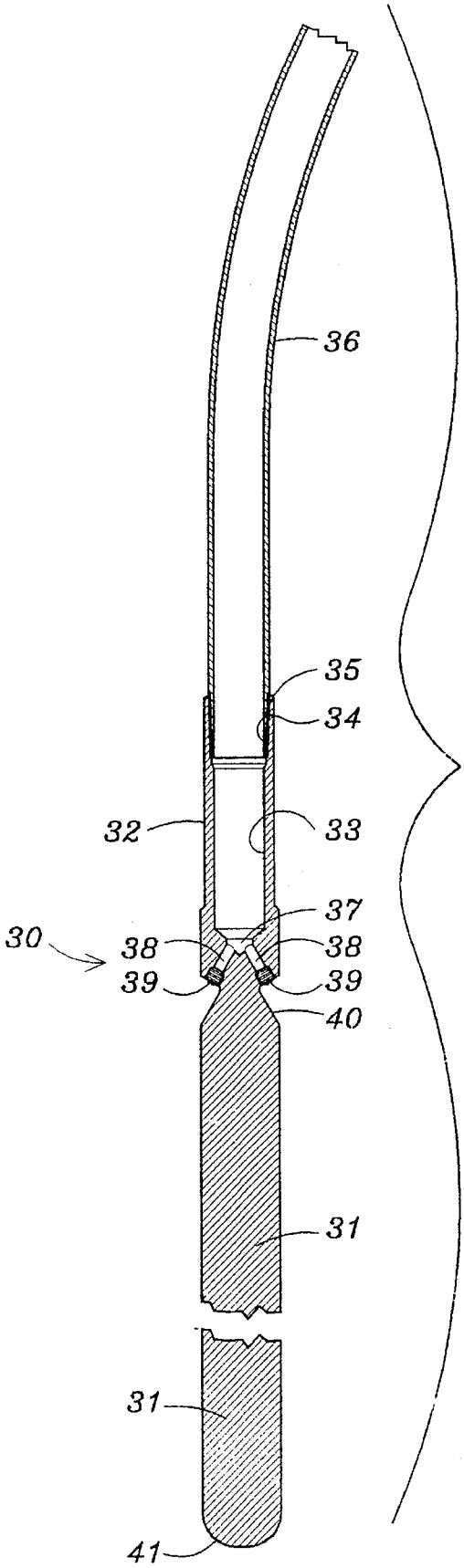
FIG. 1 is a cross-sectional view of a simulator unit having a motor-pump simulator and a piston receiver attached to a coil tubing.

FIG. 1 shows a simulator unit 30 having a lower motor-pump simulator 31 integral with an upper piston receiver 32. Piston receiver 32 has a bore 33 with an internally threaded end 34 connected to a externally threaded first end 35 of the coil tubing 36. Bore 33 has an inside diameter the same as the inside diameter of the coil tubing. The piston receiver has a small reservoir 37, two small passageways 38 for receiving check valves 39, and a 90° circumferential grove 40 for installation of the check valves. The motor-pump simulator 31 consists of a length of solid steel having approximately the same outside diameter and length as those of the actual motor-pump assembly to be eventually deployed down the well. The bottom portion of motor-pump simulator 31 contains a 60° taper 41 to facilitate slippage into the production tubing string 52 of the well. The top portion of motor-pump simulator 31 transitions into the bottom portion of piston receiver 32 just below the check valves.

Bore 33 has an internal length long enough to receive a small piston 78 discharged from first end 35 of coil tubing 36. In one embodiment the length of bore 33 is about 34" and reservoir 37 has an internal length of about 2.5".

Figure 2:
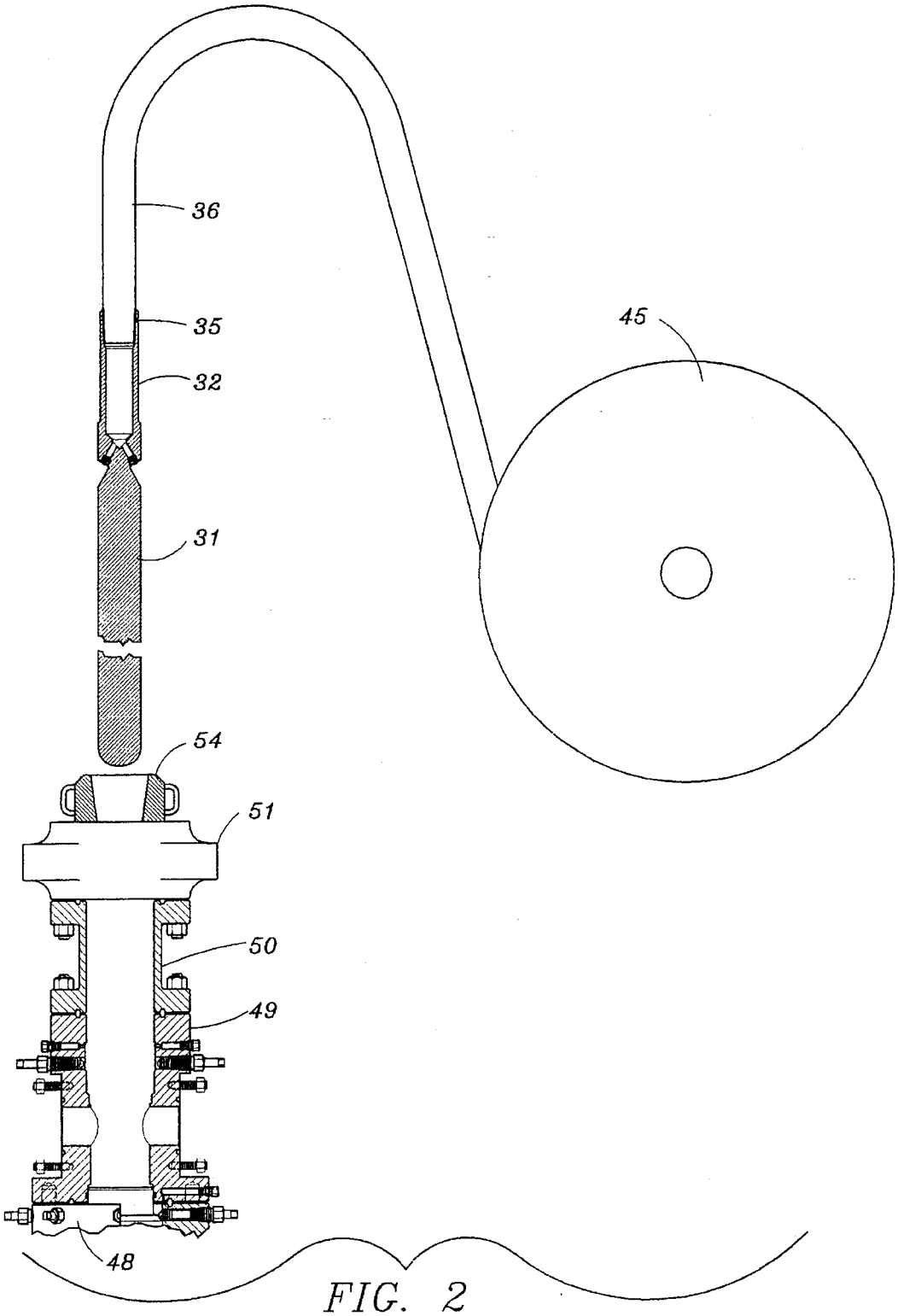
FIG. 2 illustrates the simulator unit connected to coil tubing fed from a reel, ready for running in a wellhead assembly.

Referring to FIG. 2, a first end 35 of the coil tubing is pulled from coil tubing reel 45 and threaded. Reel 45 contains enough coil tubing to reach the lowest operating well depth if pumping is going to conducted at several depths, an extra length for above ground use, plus preferably some extra length just in case more should be needed. For many wells reel 45 may contain 8000 ft or more of coil tubing in a single piece. Accordingly, reel 45 shown in FIG. 2 is not drawn to scale and would be much larger than shown if drawn to scale. After simulator unit 30 is screwed onto threaded end 35 of the coil tubing it is bent over and the coil tubing with the simulator unit 30 attached is deployed down the well using well known equipment not shown in the figures. It is to be understood that the coil tubing can be fed into the well from the reel and, when retrieved from the well, rewounded back onto the same reel or another reel. Accordingly, FIG. 2 shows a reel 45 of coil tubing with a first threaded end 35 attached to simulator unit 30 positioned to begin deployment into the wellhead 47 and down the production tubing string in the well.

Figure 3:
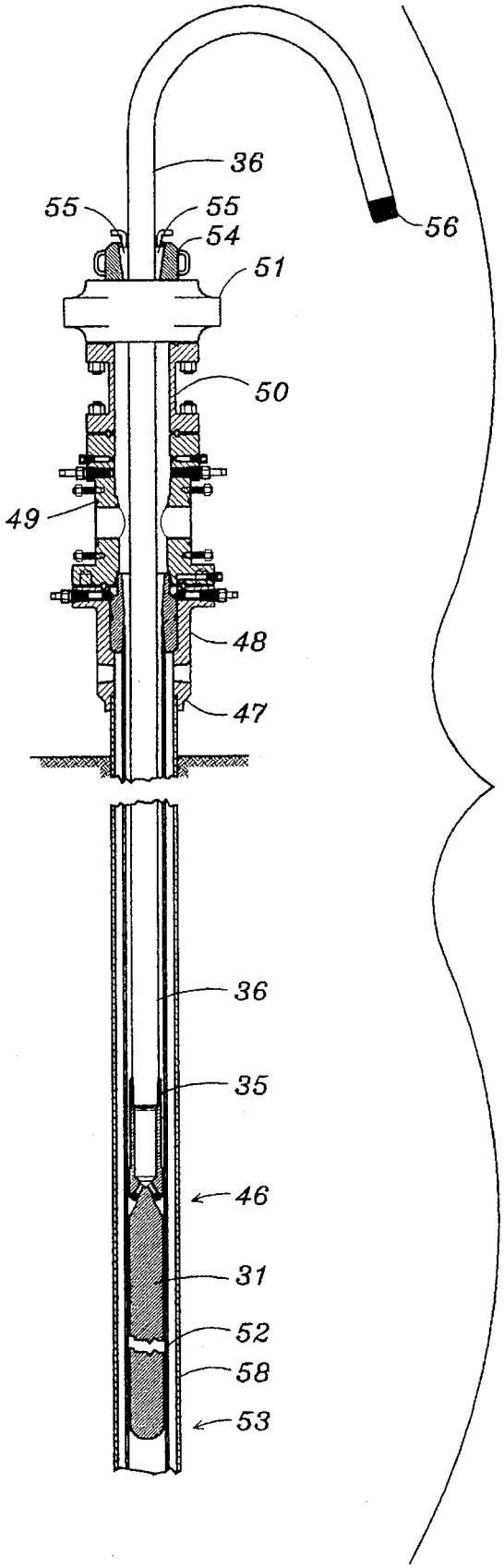
FIG. 3 illustrates the simulator unit deployed down a well with the coil tubing cut off from the reel.

FIG. 3 shows a well 46 having wellhead 47 connected to production casing 58. Attached to wellhead assembly 47 are tubing head spool 48, diversionary member or spool 49, BOP adapter spool 50 and BOP 51. The coil tubing with simulator unit 30 attached thereto is lowered into the wellhead through BOP 51, BOP adapter spool 50, diversionary spool 49, tubing head spool 48, and down production tubing string 52 until simulator unit 30 reaches the desired operating well depth 53 as illustrated in FIG. 3. The BOP is then closed. For the wellhead illustrated in FIG. 3, production tubing string 52 is suspended from tubing head spool 48.

If the split spider 54 is not already sitting on top of BOP 51, then it is positioned as shown in FIG. 3 and closed. Hand slips 55 are inserted into split spider 54 to support the coil tubing and simulator unit in the well. With the coil tubing supported by the hand slips, and at operating well depth, the coil tubing is then cut off at a convenient distance from the wellhead and threaded thereby forming a threaded second end 56. The length of the coil tubing between second end 56 and the wellhead should be at least enough for guiding a power cable, when installed in the coil tubing, towards the junction box of a power source (not shown in the figures).

Figure 4:
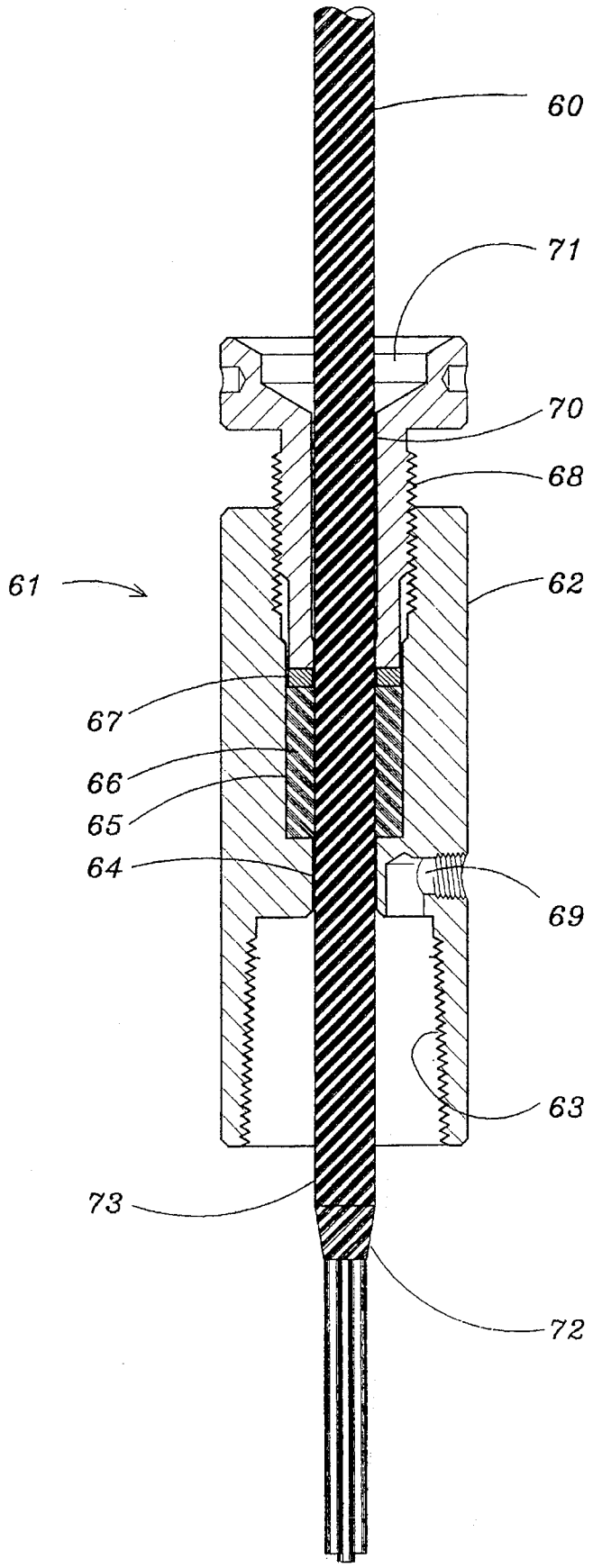
FIG. 4 illustrates a cable seal assembly.

To illustrate a method of installation of the power cable 60 in coil tubing 36, reference is made to FIGS. 4–8. FIG. 4 illustrates a cable seal assembly 61 with outer body 62, having an internally threaded first end 63 for screwing onto the second end 56 of coil tubing, first bore 64 for passage of power cable 60, second bore 65 for receiving Torlon-silicon seal 66, compression ring 67, and the lower end of compression screw 68. Outer body 62 also has a passageway 69 for introducing a pressurized fluid into first end 63. Screw 68 has bore 70 for running power cable 60 therethrough, and cup-well 71 for holding a lubricant if necessary.

Figure 5:
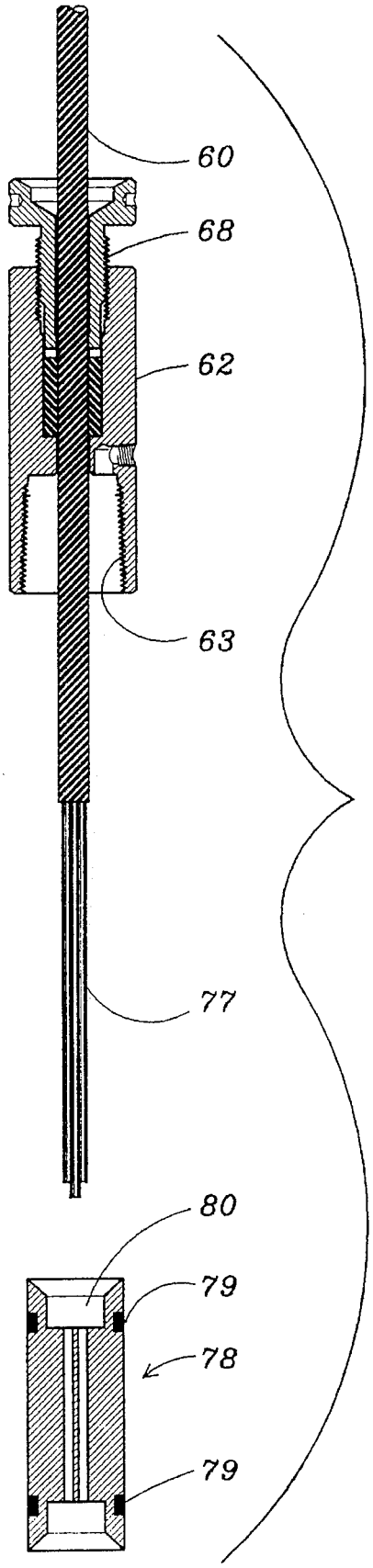
FIG. 5 illustrates a power cable in the cable seal assembly of FIG. 4 ready for connection to a piston.

The power cable is supplied on a reel (not shown in the figures) which holds enough cable to traverse at least the length of the coil tubing and about 100 ft more. A tapered end 72 is formed on the shielding jacket 73 of power cable 60 to facilitate pushing it through screw 68 and cable seal assembly 61. After pushing power cable 60 through cable seal assembly 61, as shown in FIG. 4, shielding jacket 73 is square cut exposing about 8" of electrical leads 77 as shown in FIG. 5.

Figure 6:
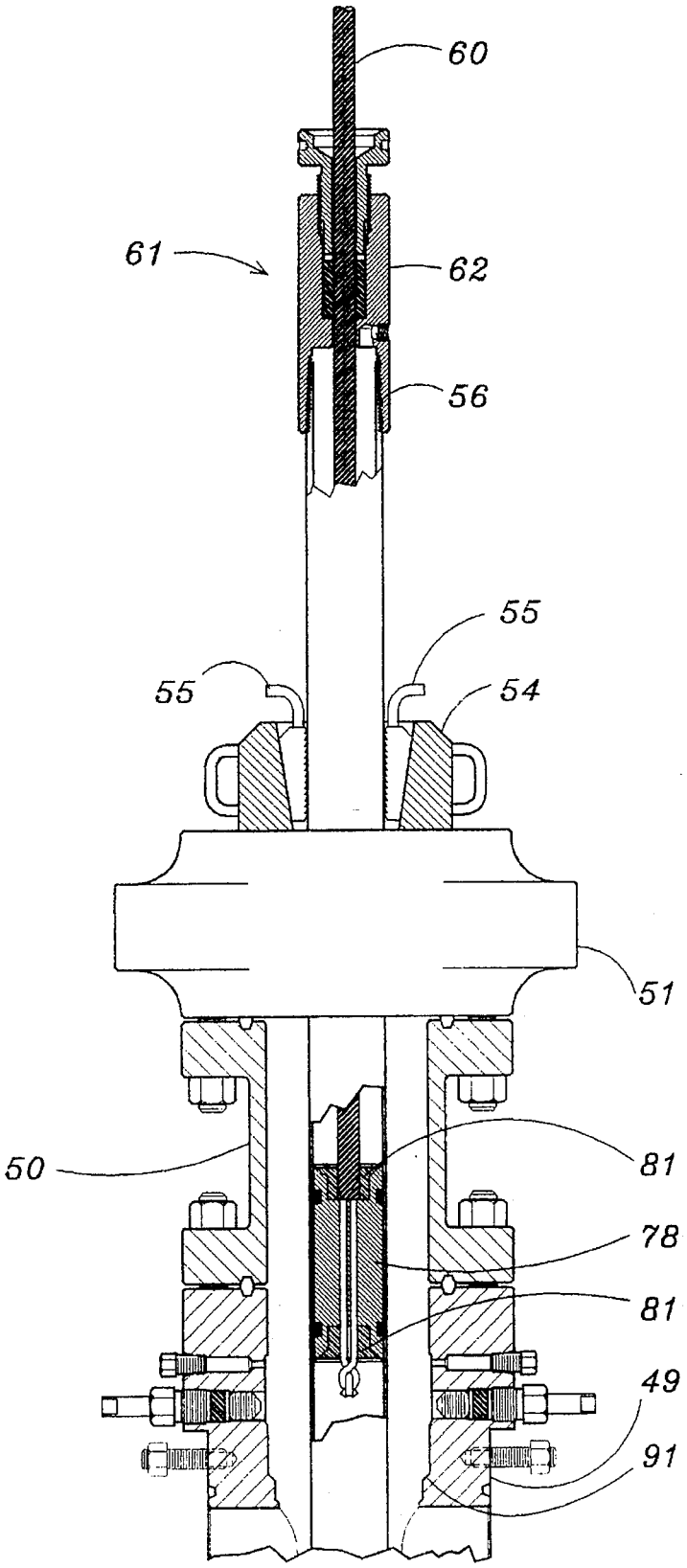
FIG. 6 illustrates the piston and power cable of FIG. 5 inserted into the coil tubing.

Leads 77 are inserted through three parallel holes in piston 78 and twisted together at their ends as shown in FIG. 6. Piston 78 has two circumferential seals 79, end recesses 80, and an outside diameter slightly smaller than the inside diameter of the coil tubing 36. After twisting the ends of the leads together, end recesses 80 are filled with epoxy 81 to seal power cable 60 to piston 78. Piston 78 is inserted by hand a short distance into second end 56 of coil tubing 36. Cable seal assembly 61 is then screwed onto the second end 56 of the coil tubing as shown in FIG. 6.

Figure 7:
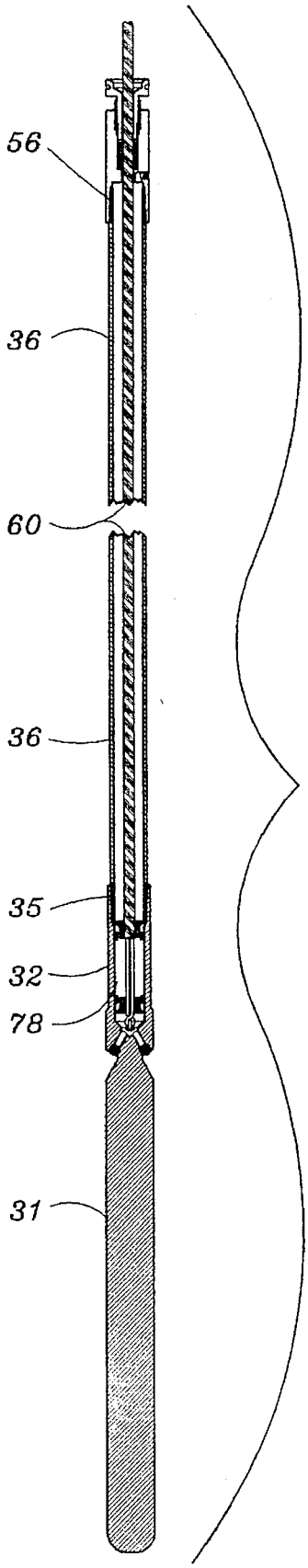
FIG. 7 illustrates the power cable deployed through the coil tubing.

A pressurized gas, e.g. air or nitrogen, is introduced through passageway 69 to drive piston down through the coil tubing until piston 78 emerges out first end 35 and stops in bore 33 of piston receiver 32 as shown in FIG. 7. The power cable is then cut off from its reel, thereby forming a second end 84, at a convenient distance from the second end of the coil tubing. With power cable installation in coil tubing completed, hand slips 55 are removed, the BOP opened, and the coil tubing with the simulator unit attached is retrieved from the well.

Figure 8:
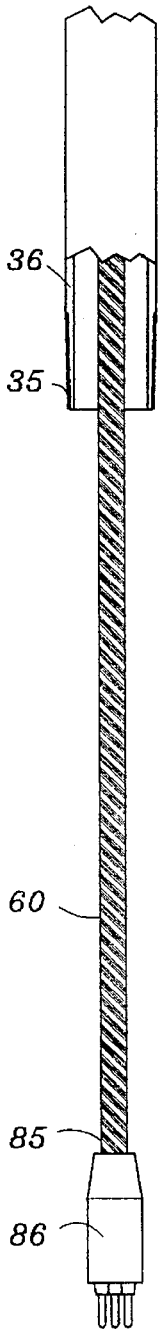
FIG. 8 shows the power cable connected to a motor flat connector.

To retrieve the coil tubing the second end 56 of coil tubing is connected to the same reel 45 or another reel and rewound until simulator unit 30 is out of the wellhead 47. Simulator unit 30 is disconnected from the coil tubing thereby exposing piston 78. The power cable is then cut off at the piston thereby forming a first end 85 and the piston discarded. The first end 85 of power cable 60 is then connected and potted to a motor flat connector 86 as shown in FIG. 8. In one embodiment, the outer housing 101 of retrievable sealing plug coil tubing suspension device 100 is inserted over the motor flat connector 86. Other components of the device can also be slipped over motor flat connector 86 at this point if desired, the details of which are described later.

Figure 14:
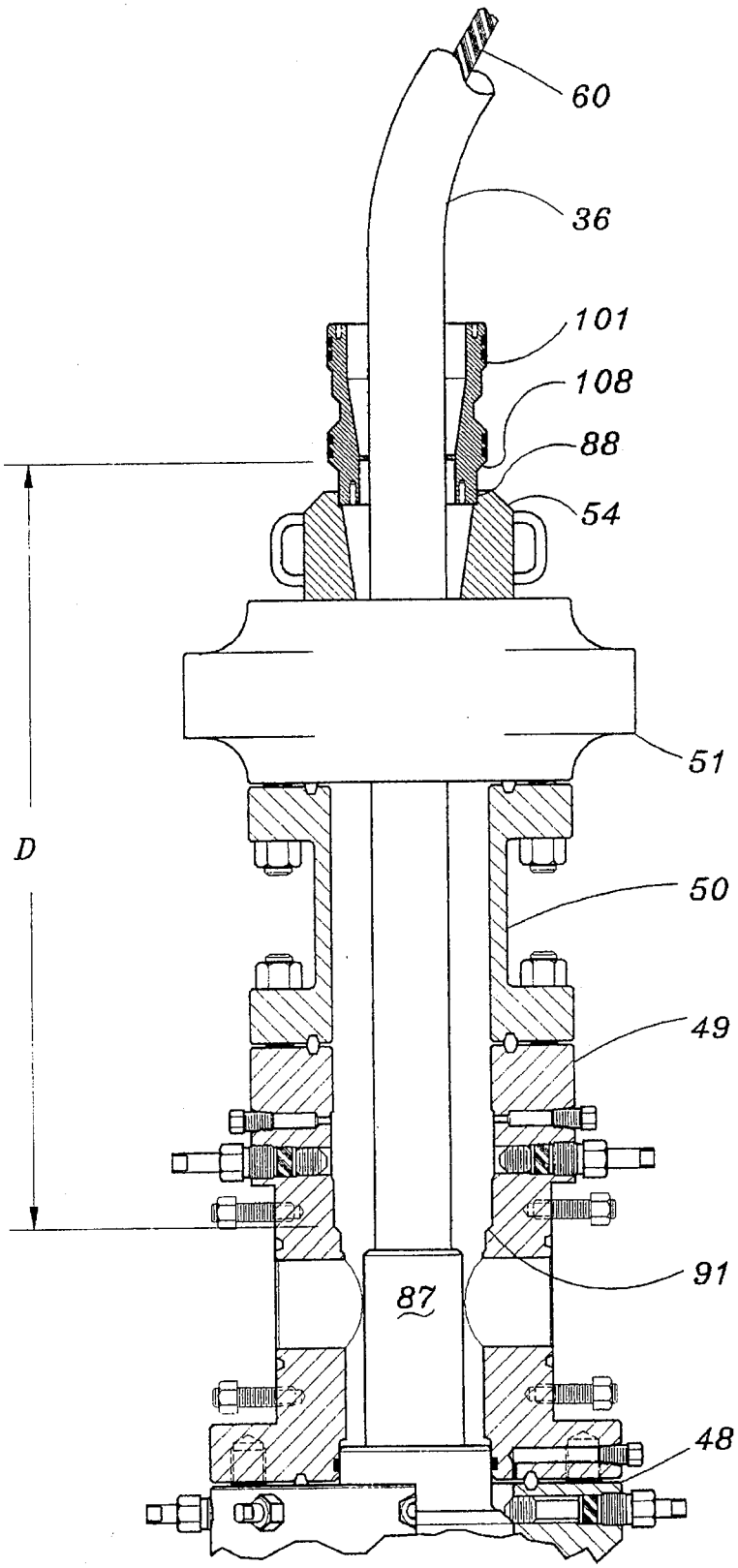
FIG. 14 is a cross-sectional view of motor-pump assembly as it is being lowered into the wellhead assembly with the outer housing of FIG. 9 on top of a split spider.

With reference to FIG. 14, the motor flat connector 86 is then connected to the motor of the motor-pump assembly 87 and the motor-pump assembly 87 screwed onto first end 35 of the coil tubing. The coil tubing with the motor-pump assembly attached thereto is then lowered back into the wellhead and down the production tubing string 52 until the motor-pump assembly reaches the operating well depth 53. While lowering the coil tubing into the well, the outer housing 101 of the device is set in the recessed pocket 88 at the top of the closed split spider 54. When the motor-pump assembly is at the operating well depth in the well, a first "X" mark 90 is made on the coil tubing opposite the top of the annular outer housing, see FIG. 15.

Figure 15:
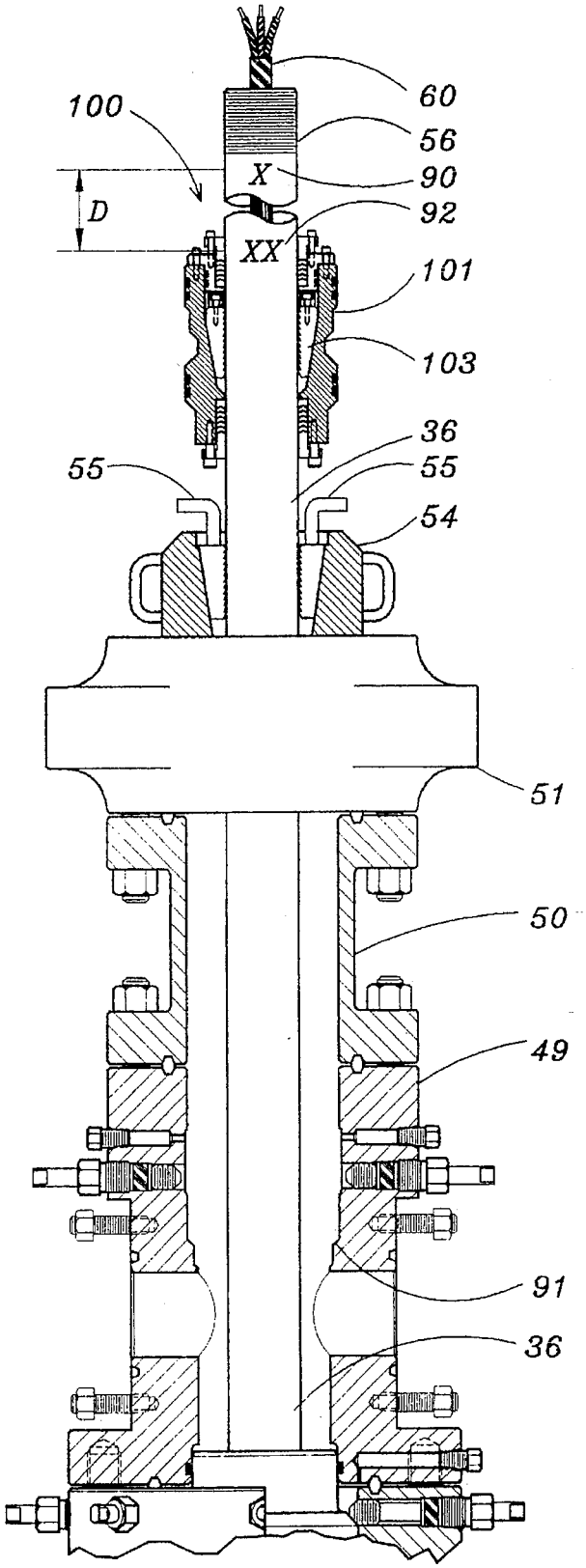
FIG. 15 is a cross-sectional view similar to FIG. 14 with the device of FIG. 9 locked on the coil tubing at "XX".

A predetermined adjustment distance equal to the distance from the outer seating shoulder 108 of the outer housing as it rests on the top of BOP 51 to the inner seating shoulder 91 of the diversionary member 49 is determined, which is shown as distance "D" in FIG. 14. The coil tubing is then raised a distance slightly larger than the length "D", the hand slips 55 then installed in split spider 54 to support the coil tubing, and the BOP closed. A second "XX" mark 92 is then made on the coil tubing at a distance equal to "D" below the first "X" mark 90 to indicate where the device is to be locked onto the coil tubing as shown in FIG. 15. Thus the distance "D" between the first "X" mark and the second "XX" mark, as shown on FIG. 15, is equal to the distance "D" shown in FIG. 14.

A slip assembly 102 is then assembled around the coil tubing and inserted into the conical bore section 103 of the vertical channel 104 of outer housing 101. With the three slips 105 aligned and positioned between the coil tubing and conical bore section 103, and the top of the outer housing being held by hand at the second "XX" mark, the hand slips are removed and the BOP opened. The coil tubing is then slowly and carefully lowered until the bottom of the outer housing fits into recess pocket 88 of split spider 54. Then the full weight of the coil tubing and motor-pump assembly is lowered to set the slips around the coil tubing and position the top of outer housing 101 at the second "XX" mark, and the BOP closed.

Locking means 106 of the device is then slipped over second end 56 of the coil tubing and bolted to outer housing 101 thereby locking the outer housing-slip assembly-locking means subassembly to the coil tubing. O-rings 107 provide an intermediate seal means for preventing fluid flow between the locking means and the outer housing. A compression ring or rings, each having a packing subassembly, are then installed on the locking means and/or outer housing to provide inner seal means for preventing fluid flow between the locking means and coil tubing and/or the outer housing and the coil tubing. The locking means, outer housing and seal means form a subassembly which is a component of the retrievable sealing plug coil tubing suspension device of this invention which is described in detail later.

Figure 16:
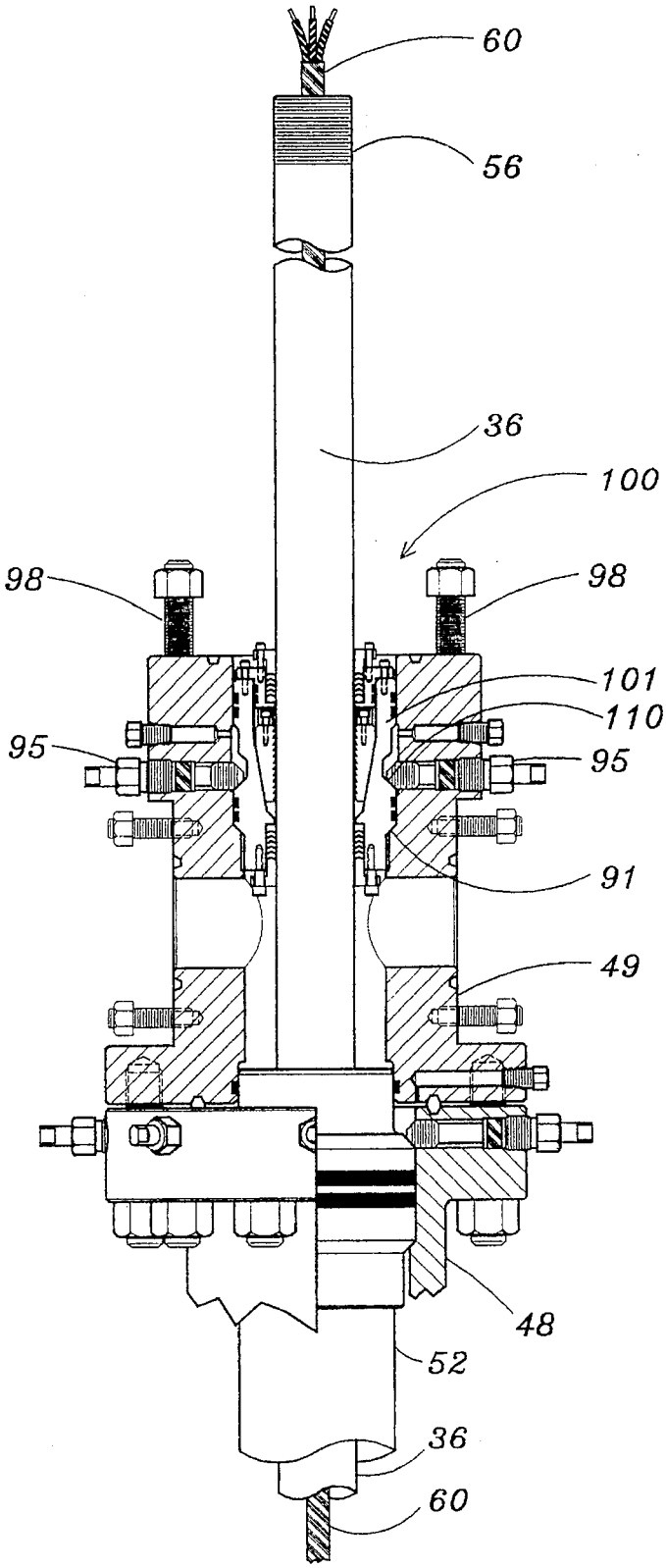
FIG. 16 is a cross-sectional view similar to FIG. 15 with the device locked on the coil tubing and locked in the diversionary member.

Hand slips 55 are removed, the BOP opened, and the coil tubing raised slightly to allow the split spider 54 to be opened and removed. The coil tubing is then lowered until shoulder 108 of outer housing 101 lands on shoulder 91 of diversionary member 49. O-rings 109 provides means for preventing fluid leakage between the diversionary member and the device. The device is then secured in the diversionary member with six locking screws 95 which engage outer circumferential recess 110 on the outer housing shown in FIG. 16. The motor-pump assembly is at this point rigidly supported at the desired operating well depth 53.

With the device locked in diversionary member 49, split spider 54, BOP 51 and BOP adapter spool 50 are then removed. Bonnet 96 is then slid over the second end 56 of coil tubing and sealably connected to the top of the diversionary member with gasket 97 and six studs 98 and nuts 98' as shown in FIG. 17. Leakage between the bonnet and the coil tubing 36 is prevented with seal assembly 99. The second end 84 of the power cable is then connected to a power source (not shown in the figures) thereby completing the well for electric submersible pump production.

Figure 9:
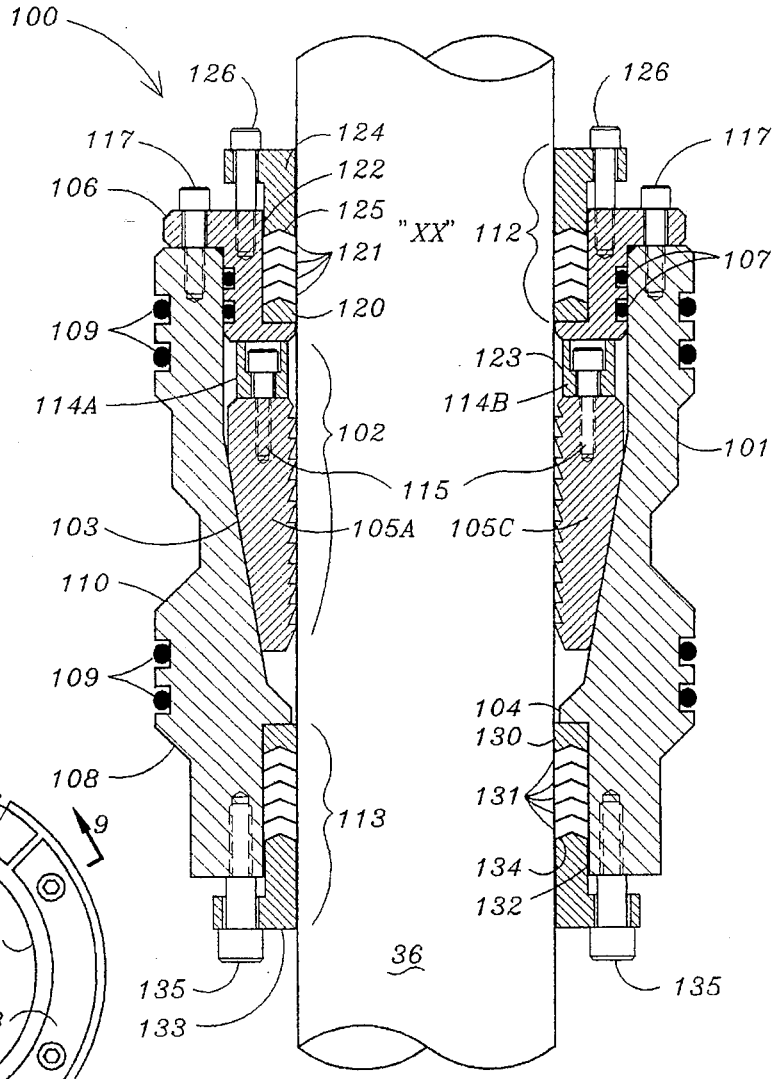
FIG. 9 is a cross-sectional view of the retrievable sealing plug coil tubing suspension device locked on coil tubing.
Figure 12:
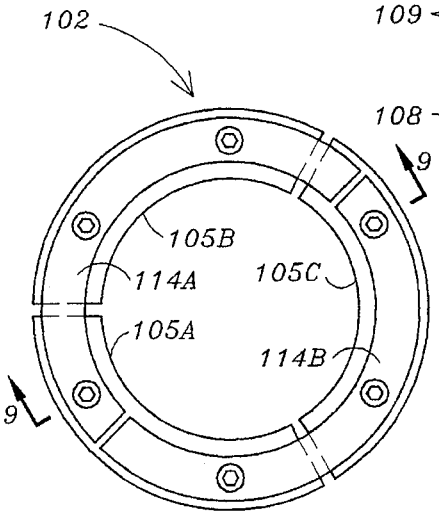
FIG. 12 is a top plan view of the slip assembly of FIG. 9.
Figure 10:
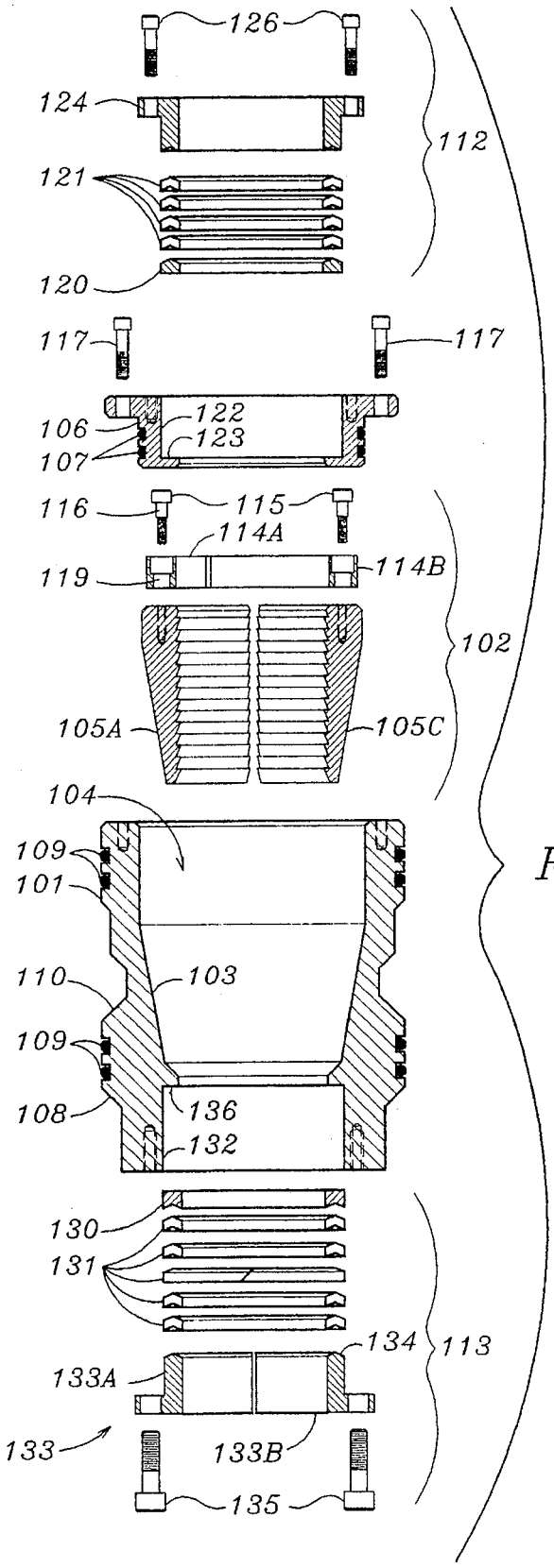
FIG. 10 is an explosive view of the device of FIG. 9.

One embodiment of the retrievable sealing plug coil tubing suspension device is shown in FIGS. 9–12. FIG. 9 shows the device assembled and gripping coil tubing 36, and FIG. 10 shows the components of the device in explosive format. The main members of device 100 are outer housing 101, slip assembly 102, locking means 106, outer seal means 107, upper inner seal means 112, lower inner seal means 113 and intermediate seal means 107. Device 100 is locked around the coil tubing 36 in the following manner. The outer housing 101 is positioned at the spot on the coil tubing where the device is going to be locked, i.e. the second "XX" mark 92. Three slips 105A, 105B and 105C, sometimes referred to collectively as slips 105, and two piece split ring 114A and 114B, sometimes referred to collectively as split ring 114, are assembled above the outer housing around the coil tubing thereby forming slip assembly 102. FIG. 12 shows how the three slips 105 (consisting of individual slips 105A, 105B and 105C) are connected to split ring 114 (consisting of individual semi-rings 114A and 114B). In particular first semi-ring member 114A slidably supports both slip 105A and slip 105B, and second semi-ring member 114B slidably supports both slip 105A and slip 105C. The slip assembly is inserted into the conical section 103 of the vertical channel 104 of the outer housing. By lowering the weight of the coil tubing upon the slips, the teeth of the slips grip the coil tubing.

Split ring 114 is slidably fastened to slips 105 with bolts 115. Bolts 115 contain a middle portion 116 which is slightly longer than the depth of the lower portion 119 of the corresponding bolts holes in split spider 114 which prevents the split spider from being drawn up tight against slips 105 thereby allowing enough movement of the slips to effect firm engagement of the coil tubing.

Locking means 106 having two O-rings 107, is attached to outer housing 101 with six bolts 117. O-rings 107 provide intermediate seal means for preventing fluid flow between the locking means 106 and the outer housing 101. At this point the outer housing, slip assembly and locking means are firmly locked to the coil tubing and will remain locked until the locking means is unbolted and removed, and the slip assembly unwedged from between the coil tubing and the conical bore section of the outer housing.

A metal Chevron ring 120 and four Chevron packing rings 121 are then installed in upper recessed inner circumferential section 122 on top of Chevron shaped shoulder 123 of locking means 106. Upper compression ring 124 having a Chevron shaped lower surface 125 is then bolted to the top of locking means 106 with six bolts 126 thereby compressing the Chevron packing and forming a first inner seal means 112 between the coil tubing and the locking means. Locking means 106, rings 120 and 121, and upper compression ring 124 are slipped over the second end 56 of the coil tubing, or alternatively were slipped over the first end 35 of the coil tubing ahead of the outer housing 101 as described earlier. Alternatively a split ring configuration can be used for rings 120 and 121 and compression ring 124, however, locking means 106, which does not have a split configuration, must be installed by slipping over either the first end 35 or second end 56 of the coil tubing.

Figure 11:
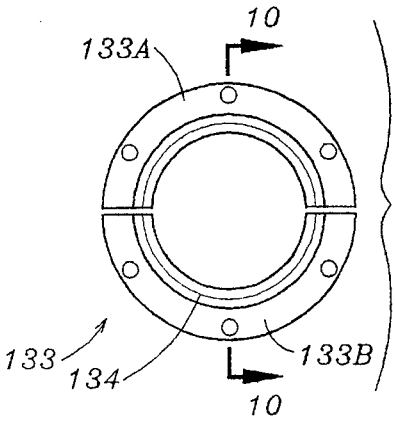
FIG. 11 is a top plan view of a lower compression ring of FIG. 10.

With reference to FIG. 11, in a somewhat similar manner, a metal Chevron ring 130 and five Chevron packing rings 131 are installed against shoulder 136 in lower recessed inner circumferential section 132 of outer housing. Lower compression ring 133 having a Chevron shaped upper surface 134 is then bolted to the bottom of outer housing 101 with six bolts 135 thereby compressing the Chevron packing and forming a second inner seal means 113 between the coil tubing and the outer housing. Rings 130 and 131, and lower compression ring 132 can be a split ring configuration. FIG. 11 shows the split ring configuration of lower compression ring 133 having semi-circular haves 133A and 133B.

In an alternative embodiment, rings 130 and 131, and lower compression ring 132 can each have a single piece continuous annular form which are slipped over the first end 35 of the coil tubing after the outer housing 101 and before attaching the motor-pump assembly 87.

In another alternative embodiment, only one of the inner seal means is used, i.e. either means 112 having upper compression ring 124 with metal Chevron ring 120 and four Chevron packing rings 121, or means 113 having lower compression ring 133 with metal Chevron ring 130 and five Chevron packing rings 131. Preferably both inner seal means 112 and 113 are used. When both are used slip assembly 102 can be packed with a corrosion preventive material or grease so that disassembly the device 100 and recovery of its components and their reuse can be easily performed at any time, or after the useful life of the well.

Figures 13A, 13B:
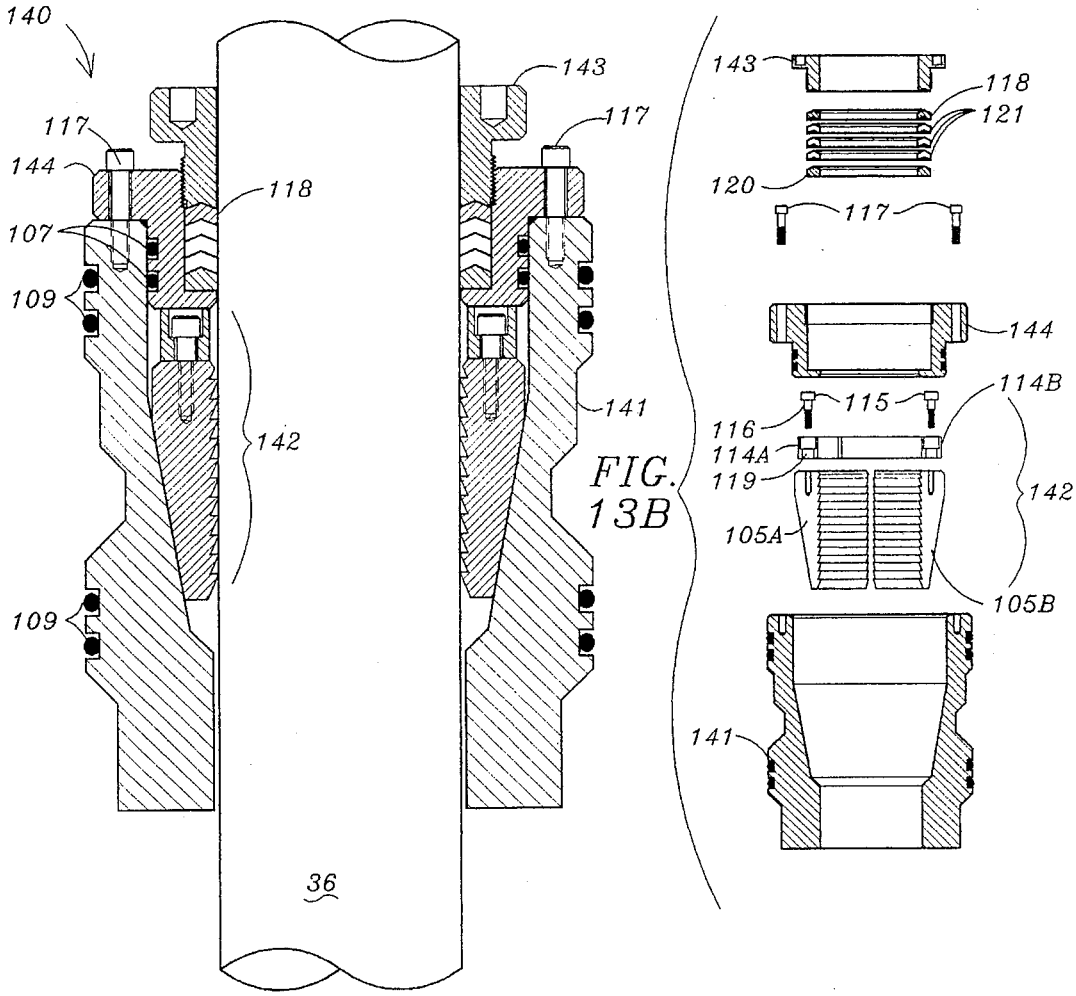
FIG. 13A is a cross-sectional view of a second embodiment of the retrievable sealing plug coil tubing suspension device locked on coil tubing.
FIG. 13B is an explosive view of the device of FIG. 13A.

FIGS. 13A and 13B illustrates another embodiment 140 of the retrievable sealing plug coil tubing suspension device of this invention. FIG. 13A is similar to FIG. 9, and FIG. 13B is similar to FIG. 10. While outer housing 141, slip assembly 142 are very similar to outer housing 101, slip assembly 102 of FIGS. 9–12, compression ring 143 and locking means 144 are different in that ring 143 screws into locking means 144. Also in this embodiment the device does not have a lower intermediate seal means between the coil tubing and outer housing 141. Upper metal chevron ring 118 prevents damage to packing rings 121.

In general, regardless of the particular embodiment of the retrievable sealing plug coil tubing suspension device of this invention employed, i.e. the particular design of the outer housing, locking means, slip assembly, inner seal means, and intermediate seal means, the device remains locked to the coil tubing until unlocked.

When there is a need to remove the coil tubing and motor-pump assembly from the well, the device is unlocked and the slip assembly removed before the coil tubing is rewound on the coil tubing reel. To free the device from the coil tubing it is unlocked by disconnecting the inner seal means from the locking means and/or outer housing, disconnecting the locking means from the outer housing, and removing the slip assembly. Components which have a split ring configuration or overlapping ends are then removed from around the coil tubing. The other single piece continuous annular components must be removed over second end 56 of the coil tubing or allowed to slid down the coil tubing at the wellhead until the motor-pump assembly is out of the wellhead. If all of the coil tubing is to be rewound on the reel, the motor-pump assembly, the outer housing and any other remaining components of the device are removed by slipping them off over the first end of the coil tubing after removing the motor-pump assembly.

It is to be noted, however, that the power cable 60 remains in the coil tubing at all times whether the coil tubing is in the well or out of the well and rewound on the coil tubing reel. This eliminates the unstrapping and restrapping of the power cable to the outside of the coil tubing during motor-pump assembly retrieval, servicing and reinstallation thereby saving considerable manpower, time and cost. Furthermore, since the power cable is inside the coil tubing at all times it is protected from the well fluids when in the well, and from accidental damage when out of the well. Thus power cable failure is essentially eliminated.

Usually the axis of the wellhead assembly, the production tubing string, the diversionary member and its vertical passageway, and the retrievable sealing plug coil tubing suspension device and its vertical channel are all concentric. Usually the diversionary member, and the retrievable sealing plug coil tubing suspension device and its components are annular or spaced around in an annular manner such as the slips. However, non-concentric arrangements and other configurations can be use if desired.

While the preferred embodiments of the present invention have been described, it should be understood that various changes, adaptations and modifications may be made thereto without departing from the spirit of the invention and the scope of the appended claims. It should be understood, therefore, that the invention is not to be limited to minor details of the illustrated invention shown in preferred embodiment and the figures, and that variations in such minor details will be apparent to one skilled in the art.

Therefore it is to be understood that the present disclosure and embodiments of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

What is claimed is:

1. A retrievable sealing plug coil tubing suspension device comprising:

a subassembly having outer housing means having a vertical channel for running a coil tubing therethrough, support means removably positioned in the vertical channel for supporting the coil tubing, and locking means for removably locking the outer housing means and support means around the coil tubing, the locking means being removably attached to the outer housing means so that when the outer housing means and support means are locked to the coil tubing they remained locked as the subassembly is lowered through a BOP to land on a diversionary member connected to a wellhead assembly and as the subassembly is removed therefrom; and inner seal means, supported by the subassembly, for preventing fluid flow past the subassembly from between the subassembly and the coil tubing.

2. The device of claim 1, further comprising outer seal means for preventing fluid flow past the device from between the device and the diversionary member.

3. The device of claim 1, wherein the support means comprises:

a plurality of slips each having means for gripping the coil tubing and a partial conical outer surface adaptable for slidable positioning in an opposing conical section in the vertical channel, and ring means for slidably supporting the slips in a spaced apart configuration.

4. The device of claim 3, wherein the plurality of slips consist of a first slip, a second slip, and a third slip, and wherein the ring means is a split ring having a first semi-ring member and a second semi-ring member, the first semi-ring member slidably supporting the first slip and the third slip, the second semi-ring member slidably supporting the second slip and the third slip.

5. The device of claim 1, wherein the outer housing means has an outside surface of revolution and an inside surface of revolution, wherein the locking means has an outside surface of revolution and an inside surface of revolution, a bottom portion of the outside surface of revolution of the locking means being removably positioned adjacent a top portion of the inside surface of revolution of the outer housing, and intermediate seal means for preventing fluid flow between the locking means and the outer housing.

6. The device of claim 5, further comprising outer seal means for preventing fluid flow past the device from between the device and the diversionary member, the outer seal means comprising a resilient seal positioned in a circumferential recess on the outside surface of revolution of the outer housing for bearing against an opposing surface of the vertical passageway of the diversionary member;

wherein the inner seal means comprises:

a recessed inner circumferential section extending downward on the inside surface of revolution of the locking means to an inner shoulder thereon, a packing material in the recessed inner circumferential section, and compression means for compression the packing material against the recessed inner circumferential section and the coil tubing; and wherein the intermediate seal means comprises a resilient seal positioned in a circumferential recess on the outside surface of revolution of the locking means and bearing on the inside surface of revolution of the outer housing.

7. The device of claim 6, wherein the compression means comprises:

a compression ring having a lower annular section for pressing against the packing material; and force means for forcing the lower annular section of the compression ring downward against the packing material.

8. The device of claim 7, wherein the force means comprises:

plurality of space apart threaded blind bores on the locking means, a flange on the compression ring having a corresponding plurality of holes axially aligned with the threaded blind bores, and a plurality of threaded screws for insertion through the holes in the flange and screwing into the threaded blind bores, thereby compressing of the packing material.

9. The device of claim 7, wherein the force means comprises:

an internally threaded section on the locking means, and an externally threaded section on the compression ring for screwing into the internally threaded section, whereby downward rotation of the compression ring relative to the locking means compresses the packing material.

10. The device of claim 1, wherein the outer housing means has an outside surface of revolution and an inside surface of revolution, wherein the locking means has an outside surface of revolution and an inside surface of revolution, a bottom portion of the outside surface of revolution of the locking means being removably positioned adjacent a top portion of the inside surface of revolution of the outer housing, and intermediate seal means for preventing fluid flow between the locking means and the outer housing; and wherein the support means comprises:

a plurality of slips each having means for gripping the coil tubing and a partial conical outer surface adaptable for slidable positioning in an opposing conical section in the vertical channel of the outer housing, and ring means for slidably supporting each of the slips in a spaced apart configuration.

11. The device of claim 1, wherein the outer seal means is supported by the device.

12. A system for supporting a coil tubing, the coil tubing having a first end sealably attached to a motor-pump assembly and a second end above ground, the coil tubing housing a power cable having a first end connected to a motor of the motor-pump assembly and an above ground second end for connecting to a power source, the coil tubing isolating the power cable from exposure to well fluids, the system comprising:

a diversionary member;

a retrievable sealing plug coil tubing suspension device; and outer seal means;

the diversionary member including a main body having a top and a bottom, a vertical passageway in the main body extending completely therethrough from the top to the bottom, a horizontal port in the main body below the top and above the bottom, the horizontal port extending from a side of the main body into the vertical passageway, a bottom portion of the vertical passageway for fluid communication with a top portion of a production tubing string, a lower portion of the main body for removable attachment to a wellhead assembly, means for positioning the device in the vertical passageway above the horizontal port, and removable means for locking the device in the vertical passageway above the horizontal port;

the device including a subassembly having outer housing means having a vertical channel therethrough, support means removably positioned in the vertical channel for supporting the coil tubing, and locking means for removably locking the outer housing means and support means around the coil tubing, the locking means being removably attached to the outer housing means so that when the outer housing means and support means are locked to the coil tubing, they remained locked as the subassembly is lowered into the wellhead assembly and removed therefrom, and inner seal means, supported by the subassembly, for preventing fluid flow past the subassembly from between the subassembly and the coil tubing; and the outer seal means for preventing fluid flow past the device from between the device and the vertical passageway, whereby, when the device is locked to the outer housing and the coil tubing, and the locked in the vertical passageway of the diversionary member, vertical production flow from the production tubing string is diverted to horizontal production flow through the horizontal port.

13. The system of claim 12, wherein the outer housing means has an outside surface of revolution and an inside surface of revolution, wherein the locking means has an outside surface of revolution and an inside surface of revolution, a bottom portion of the outside surface of revolution of the locking means being removably positioned adjacent a top portion of the inside surface of revolution of the outer housing, and intermediate seal means for preventing fluid flow between the locking means and the outer housing; and wherein the support means includes a plurality of slips each having means for gripping the coil tubing and a partial conical outer surface adaptable for slidable positioning in an opposing conical section of the vertical channel, and ring means for slidably supporting each of the slips in a spaced apart configuration.

14. A method for removably installing at an operating well depth a motor-pump assembly suspended by a coil tubing with a power cable housed therein, within a production tubing string supported at a wellhead assembly and deployed down a well, the method comprising:

a. connecting a diversionary member having a vertical passageway, and a BOP to the wellhead assembly;

b. lowering the coil tubing with power cable therein and with the motor-pump assembly attached thereto, through the BOP and the diversionary member into the wellhead assembly and down the production tubing string until the motor-pump assembly is a small distance above the operating well depth;

c. supporting the coil tubing with split spider means positioned on top of the BOP;

d. installing an outer housing having a vertical channel around the coil tubing and on top of the split spider means, the outer housing having outer seal means for preventing fluid flow between the outer housing and the vertical passageway of the diversionary member;

e. installing a slip assembly in the vertical channel of the outer housing between the outer housing and the coil tubing;

f. setting the slip assembly in the outer housing around coil tubing;

g. attaching removable locking means to the outer housing and locking the outer housing and the slip assembly to the coil tubing with the locking means;

h. removing the split spider means supporting the coil tubing;

i. lowering the coil tubing into the well until the outer housing lands in the diversionary member; and j. securing the outer housing to the diversionary member.

15. The method of claim 14, further comprising:

connecting a BOP adapter spool between the BOP and the diversionary member before lowering the coil tubing with power cable therein and with the motor-pump assembly attached thereto, through the BOP and the diversionary member into the wellhead assembly and down the production tubing string; and when removing the BOP from the wellhead assembly also removing the BOP adapter spool.

16. The method of claim 14, wherein the small distance is equal to about the distance between the inner seating shoulder of the diversionary member and the outer seating shoulder when the outer housing is on top of the split spider means.

17. A method for removably installing at an operating well depth a motor-pump assembly suspended by a coil tubing with a power cable housed therein, within a production tubing string supported at a wellhead assembly and deployed down a well, the method comprising:

a. connecting a diversionary member having a vertical passageway with an inner seating shoulder, and a BOP to the wellhead assembly;

b. installing the power cable inside the coil tubing, the coil tubing having a first end, a second end and a length long enough to permit its first end to be located at about an operating well depth and its second end to be located a convenient distance from the wellhead assembly, the power cable having a first end, a second end and a length long enough to permit its first end to be connected to a motor of the motor-pump assembly and its second end to extend beyond the second end of the coil tubing;

c. sliding an outer housing over the first end of the coil tubing, the outer housing having a vertical channel, an outer seating shoulder for seating on the inner seating shoulder, and an outer seal means for preventing fluid flow between the outer housing and the vertical passageway of the diversionary member;

d. connecting the first end of the power cable to the motor of the motor-pump assembly;

e. connecting the motor-pump assembly to the first end of the coil tubing;

f. supporting the coil tubing with split spider means positioned on top of the BOP;

g. while maintaining axial alignment of the outer housing, the split spider means and the BOP, lowering the coil tubing with power cable therein and with the motor-pump assembly attached thereto, through the BOP and the diversionary member into the wellhead assembly and within the production tubing string until the motor-pump assembly is a small distance above the operating well depth;

h. installing a slip assembly in the vertical channel of the outer housing between the outer housing and the coil tubing;

i. setting the slip assembly in the outer housing around coil tubing;

j. attaching removable locking means to the outer housing and locking the outer housing and the slip assembly to the coil tubing with the locking means, whereby when the locking means is locked the outer housing, the support means and the locking means form a subassembly;

k. installing inner seal means for preventing fluid flow between the coil tubing and the subassembly;

l. removing the split spider means supporting the coil tubing;

m. lowering the coil tubing into the well until the outer seating shoulder of the outer housing lands on the inner seating shoulder of diversionary member;

n. securing the outer housing to the diversionary member;

o. removing the BOP from the wellhead assembly; and p. attaching a bonnet assembly to the top of the diversionary member around the coil tubing.

18. A method for removably installing at an operating well depth a motor-pump assembly suspended by a coil tubing with a power cable housed therein, within a production tubing string supported at a wellhead assembly and deployed down a well, the method comprising:

a. connecting a diversionary member having a vertical passageway with an inner seating shoulder, and a BOP to the wellhead assembly;

b. attaching a piston receiver to a first end of the coil tubing, the piston receiver being an upper portion of a simulator unit, a lower portion of which is a motor-pump simulator;

c. running the coil tubing with the simulator unit attached thereto through the BOP, the diversionary member, into the production tubing string of the well until the motor-pump simulator reaches the operating well depth;

d. supporting the coil tubing with split spider means positioned on top of the BOP;

e. cutting the coil tubing at a convenient length from the wellhead assembly, thereby forming a second end of the coil tubing;

f. attaching a first end of the power cable to a piston adaptable for fitting into, and sliding within, the coil tubing;

g. inserting the piston into the second end of the coil tubing;

h. driving the piston through the coil tubing until the piston stops at the piston receiver;

i. retrieving the coil tubing with simulator unit attached thereto from the wellhead assembly;

j. disconnecting the piston receiver from the first end of the coil tubing;

k. removing the piston from the first end of the power cable;

l. connecting the first end of the power cable to a motor of the motor-pump assembly;

m. connecting the motor-pump assembly to the first end of the coil tubing;

n. lowering the coil tubing with power cable therein and with the motor-pump assembly attached thereto, through the BOP and diversionary member into the wellhead assembly and down the production tubing string until the motor-pump assembly is a small distance above the operating well depth;

o. supporting the coil tubing with split spider means positioned on top of the BOP;

p. installing an outer housing having a vertical channel around the coil tubing and on top of the split spider means, the outer housing having an outer seating shoulder for seating on the inner seating shoulder and an outer seal means for preventing fluid flow between the outer housing and the vertical passageway of the diversionary member;

q. installing a slip assembly in the vertical channel of the outer housing between the outer housing and the coil tubing;

r. setting the slip assembly in the outer housing around coil tubing;

s. attaching removable locking means to the outer housing and locking the outer housing and the slip assembly to the coil tubing with the locking means;

t. removing the split spider means supporting the coil tubing;

u. lowering the coil tubing into the well until the outer seating shoulder of the outer housing lands on the inner seating shoulder of diversionary member; and v. securing the outer housing to the diversionary member; and w. removing the BOP and the BOP adapter member from the wellhead assembly.

19. The method of claim 18, further comprising attaching a bonnet assembly to the top of the diversionary member around the coil tubing.

20. The method of claim 18, wherein connecting the first end of the power cable to a motor of the motor-pump assembly further comprises:

potting a motor flat connector to the first end of the power cable; and connecting the motor flat connector to a mating electrical connector of a motor of the motor-pump assembly.

21. The method of claim 18, wherein the small distance is equal to about the distance between the inner seating shoulder of the diversionary member and the outer seating shoulder when the outer housing is on top of the BOP.

22. The method of claim 18, wherein installing the slip assembly in the vertical channel of the outer housing between the outer housing and the coil tubing further comprises assembling a slip assembly around the coil tubing, and inserting the slip assembly into a conical section of the vertical channel of the outer housing.

23. A method for assembling a motor-pump assembly attached to a coil tubing with a power cable housed therein for deployment through a wellhead assembly connected to a well and down the well, the method comprising:

a. connecting a diversionary member having a vertical passageway, and a BOP to the wellhead assembly;

b. attaching a piston receiver to a first end of the coil tubing, the piston receiver being an upper portion of a simulator unit, a lower portion of which is a motor-pump simulator;

c. running the coil tubing with the simulator unit attached thereto through the BOP, the diversionary member, into the well until the motor-pump simulator reaches an operating well depth;

d. supporting the coil tubing with split spider means positioned on top of the BOP;

e. cutting the coil tubing at a convenient length from the wellhead assembly, thereby forming a second end of the coil tubing;

f. attaching a first end of the power cable to a piston adaptable for fitting into, and sliding within, the coil tubing;

g. inserting the piston into the second end of the coil tubing;

h. driving the piston through the coil tubing until the piston stops at the piston receiver;

i. retrieving the coil tubing with simulator unit attached thereto from the wellhead assembly;

j. disconnecting the piston receiver from the first end of the coil tubing;

k. removing the piston from the first end of the power cable;

l. connecting the first end of the power cable to a motor of the motor-pump assembly; and m. connecting the motor-pump assembly to the first end of the coil tubing.

24. The method of claim 23, wherein connecting the first end of the power cable to a motor of the motor-pump assembly further comprises:

potting a motor flat connector to the first end of the power cable; and connecting the motor flat connector to a mating electrical connector of the motor of the motor-pump assembly.

25. The method of claim 23, further comprising:

locking a retrievable sealing plug coil tubing suspension device to the coil tubing; and landing the device in the diversionary member suspending the coil tubing with the motor-pump assembly attached thereto in the well.

* * * * *